United States Patent [19]

Anzai

[11] 4,174,680

[45] Nov. 20, 1979

[54] CLOSED LOOP AIR-FUEL RATIO CONTROL SYSTEM

[75] Inventor: Makoto Anzai, Yokosuka, Japan

[73] Assignee: Nissan Motor Company, Limited, Yokohama, Japan

[21] Appl. No.: 753,795

[22] Filed: Dec. 23, 1976

[30] Foreign Application Priority Data

Dec. 27, 1975 [JP] Japan ..... 50/176359[U]

[51] Int. Cl.[2] ..... F02B 3/00

[52] U.S. Cl. ..... 123/32 EE

[58] Field of Search ..... 123/32 EE, 32 ES; 60/276, 285

[56] References Cited

U.S. PATENT DOCUMENTS 3,871,338 3/1975 Schmidt et al. ..... 60/285

4,029,061 6/1977 Asano ..... 123/32 EE

*Primary Examiner*—Charles T. Jordan

*Attorney, Agent, or Firm*—Schwartz, Jeffery, Schwaab, Mack, Blumenthal & Koch

[57] ABSTRACT

A closed loop air-fuel ratio control system for an internal combustion engine is adapted to produce a control signal to be supplied to an air-fuel ratio regulator for regulating the air-fuel ratio of the air-fuel mixture to be supplied to the engine. The control signal is varied in amplitude in dependence on a concentration of a component in the exhaust gases upstream of a converter or reactor in the exhaust system. The control signal is composed of an integral component and a proportional component, the magnitude of the proportional component being dependent on that of the integral component.

10 Claims, 14 Drawing Figures

FIG. 5A
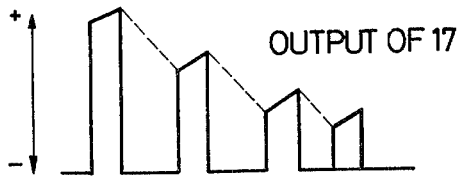
FIG. 5B
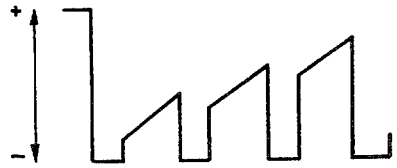
FIG. 5C
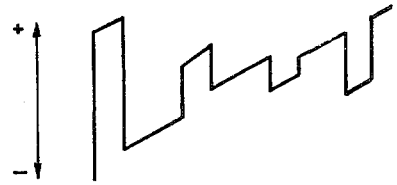
FIG. 6A
FIG. 6B
FIG. 6C
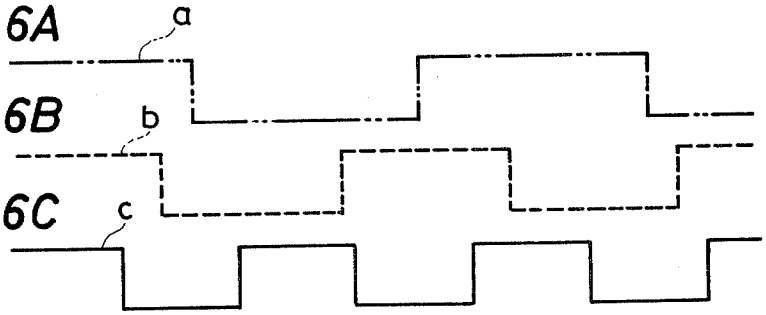
FIG. 7
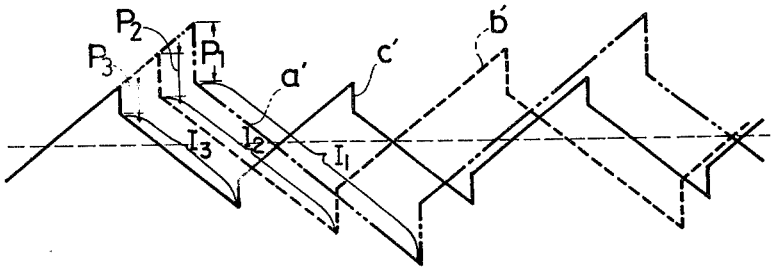

CLOSED LOOP AIR-FUEL RATIO CONTROL SYSTEM

FIELD OF THE INVENTION

The present invention relates to a closed loop air-fuel ratio control system for controlling the ratio of air to fuel of the air-fuel mixture to be supplied to an internal combustion engine.

BACKGROUND OF THE INVENTION

It is well known in the art that the types and amounts of substances present in exhaust gases from an internal combustion engine are greatly affected by the ratio of air to fuel in the mixture supplied to the engine. Rich mixtures, with excess fuel, tend to produce higher amounts of hydrocarbons and carbon monoxide, whereas lean mixtures, with excess air, tend to produce greater amounts of oxides of nitrogen. It is also well known in the art that exhaust gases can be treated so as to reduce the amounts of these undersirable components. An example of this treatment is catalytic treatment in which carbon monoxide and hydrocarbons are oxidized and nitrogen oxides are reduced.

Such treatment can be achieved by providing a catalytic converter and/or a reactor in the exhaust system of the engine. It has been suggested that oxidation and reduction for minimization of undesirable constituents is preferably performed when the air-fuel ratio of the exhaust gases upstream of the converter or reactor is maintained within a narrow range at, for example, stoichiometry.

In order to maintain the air-fuel ratio of the exhaust gases upstream of the converter or reactor, various air-fuel control systems have been developped. A typical approach utilizes a detector for detecting the air-fuel ratio of the exhaust gases upstream of the converter etc., a control signal generator for generating a control signal varying in amplitude in accordance with variations in the air-fuel ratio of the exhaust gases, and an air-fuel ratio regulator for regulating the air-fuel ratio of the air-fuel mixture to be supplied to the engine in response to the control signal.

Since variations in the air-fuel ratio of the exhaust gases appear after an appreciably long delay in the exhaust gases, the control signal undergoes undesirable hunting about a central level corresponding to a desired air-fuel ratio of the exhaust gases. In order to suppress the amplitude in this hunting of the control signal, various techniques have been utilized with the control system. However, difficulty is still encountered in conventional air-fuel ratio control systems.

OBJECTS OF THE INVENTION

It is therefore a principal object of the present invention to provide an improved closed loop air-fuel ratio control system which can appreciably suppress the magnitude of hunting in the control signal used for controlling the air-fuel ratio regulator.

SUMMARY OF THE INVENTION

Briefly described, an air-fuel ratio control system according to the present invention produces a control signal containing proportional and integrated components, the magnitude of the proportional component being varied according to the magnitude of the integrated component.

BRIEF DESCRIPTION OF THE DRAWINGS

FIGS. 5A, 5B and 5C show waveforms of signals occurring in the circuit of FIG. 4; and FIGS. 6A, 6B, 6C and 7 show waveforms of signals occurring in the circuit of FIG. 4.

DESCRIPTION OF THE PREFERRED EMBODIMENTS

Figure 1:
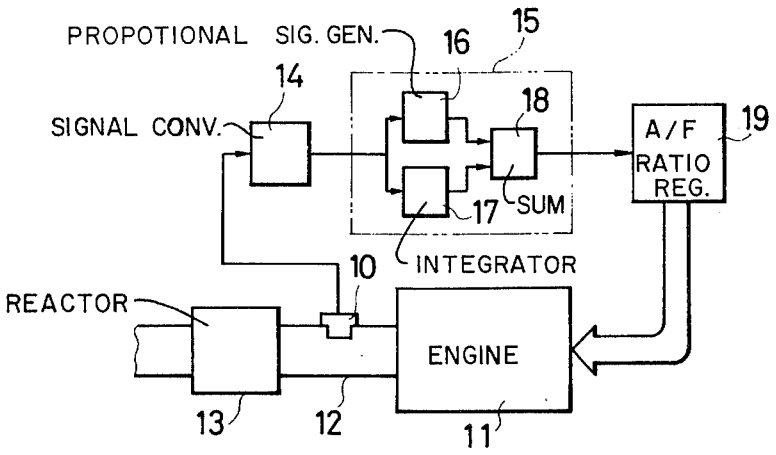
FIG. 1 is a schematic block diagram showing a prior art air-fuel ratio control system.
Figure 2:
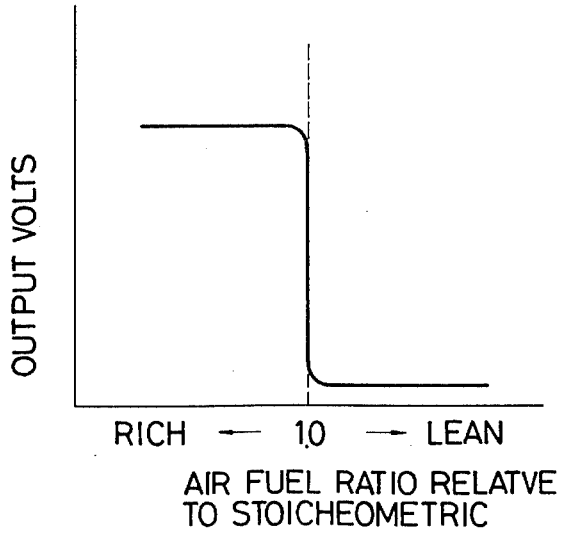
FIG. 2 is a graph showing a typical output characteristic of an $O_2$ sensor as a function of air-fuel ratio in the exhaust gases.

The preferred embodiment of the instant invention is better understood in light of the prior art as exemplified by FIGS. 1–3.

Referring now to FIG. 1, there is shown a conventional air-fuel ratio control system, which utilizes a concentration detector 10, such as an $O_2$ sensor, for detecting a concentration of a component in the exhaust gases of an internal combustion engine 11. The engine 11 exhausts into the exhaust passage 12 upstream of a catalytic converter or a reactor 13 for promoting oxidation and/or reduction of harmful components in the exhaust gases. The concentration detector 10 produces a higher signal when a concentration of a component in the exhaust gases is higher than a preselected level, and a lower signal when the concentration is lower than the preselected level. It is to be noted that the conventional concentration detector cannot adequately detect with precision the concentration of a specific component. The signals from the detector 10 are applied to a signal converter 14 which produces an air-fuel ratio signal in response to the signals from the detector 10. The signal converter 14 preferably includes a comparator, a differential amplifier, or like circuitry. The detector 10 and signal converter 14 constitute an air-fuel ratio detector. The output signal from the air-fuel ratio detector is applied to a control circuit 15 which includes a proportional signal generator 16, an integrator 17 and a summing circuit 18. A control signal of the control circuit 15 is applied to an air-fuel ratio regulator 19 which regulates the air-fuel ratio of the air-fuel mixture to be supplied to the engine 11 in accordance with the output signal from the control circuit 15.

FIG. 2 shows a typical output characteristic of the concentration detector 10. As seen from this figure, the concentration detector cannot detect an instantaneous true magnitude of deviation from a central level of a concentration of a component in the exhaust gases, but merely produces signals indicative of the concentration of the component that is higher than a preselected level or vice versa.

Figure 3A:
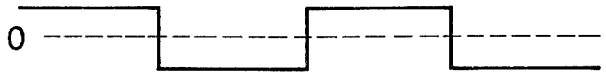
FIGS. 3A, 3B, and 3D show waveforms of signals occurring in the system of FIG. 1.

FIG. 3A shows a typical waveform of the air-fuel ratio signal from the signal converter 14 at a relatively low vehicle speed. When such signal as shown in FIG. 3A is applied to the control circuit 15, the proportional signal generator 16 and the integrator 17 cooperate to produce a so-called P-I control signal such as that shown by a solid line in FIG. 3B. The P-I control signal consists of proportional components P and integral components I. As seen from FIG. 3B, the output signal from the control circuit varies about a center level or reference value with a deviation of a magnitude d. The reference level corresponds to a desired air fuel ratio in the exhaust gases. FIGS. 3C and 3D, respectively, show waveforms of output signals from the signal conveter 14 and the control circuit 15 at a relatively high vehicle speed. As seen from these figures, hunting in the control signals is caused by delay times t occurring in the overall air-fuel ratio control system.

Figure 3B:
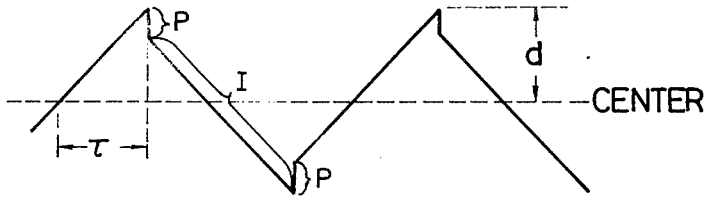
FIG. 3B PRIOR ART
Figure 3C:
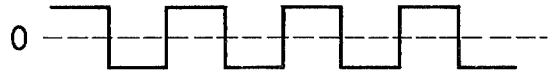
Figure 3D:
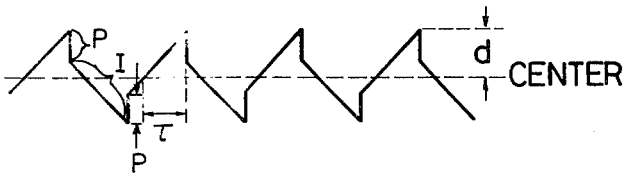
FIG. 3D PRIOR ART

In the conventional air-fuel ratio control system, the proportional component P in the control signal has a constant amplitude notwithstanding variation in vehicle speed, as seen from FIGS. 3B and 3D. Thus, difficulty has been encountered in air-fuel ratio control when using conventional control systems. This difficulty is more pronounced at relatively low vehicle speeds.

In order to overcome the above-mentioned problems, the present invention provides an improved control circuit for the air-fuel ratio control circuit.

Figure 4:
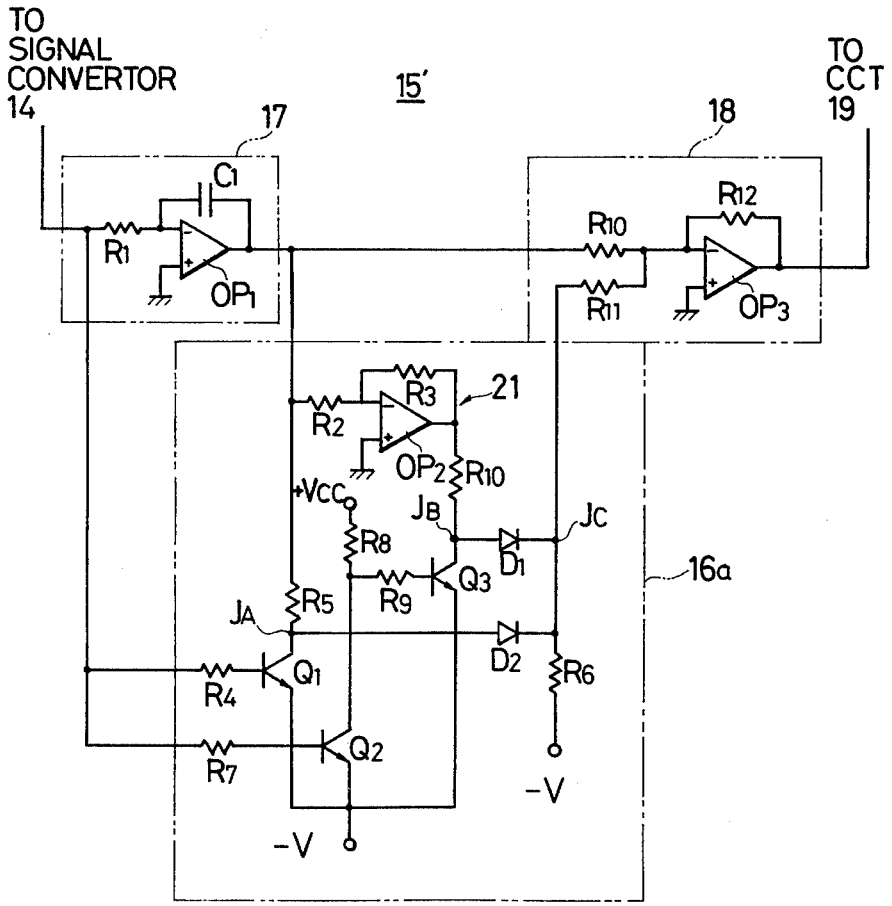
FIG. 4 shows a circuit arrangement of a air-fuel ratio control system according to the present invention.

FIG. 4 shows a preferred control circuit 15' according to the present invention, which comprises an integrator 17 including an operational amplifier $OP_1$ having its non-inverting input grounded and its inverting input connected through a resistor $R_1$ to the output of the signal converter 14. A capacitor $C_1$ is connected across the inverting input and the output of the operational amplifier $OP_1$. An improved proportional component generator **16*a* is provided which functions to produce a proportional component with an amplitude varying in accordance with the magnitude of the integrated component. The proportional component generator 16*a* includes an inverter 21 having an operational amplifier $OP_2$ that has its non-inverting input grounded and its inverting input connected through a resistor $R_2$ to the output of the circuit 17**. A resistor $R_3$ is connected across the inverting input and output of the operational amplifier $OP_2$.

The circuit **16*a* further includes switching circuitry for selectively passing therethrough the output signals from the integrator 17 and the inverter 21 in accordance with the sign, i.e. positive or negative, of the output signal from the signal converter 14. The switching circuit includes a transistor $Q_1$ having its base connected through a resistor $R_4$ to the signal converter 14 and its collector connected through a resistor $R_5$ to the output of the integrator 17. The emitter of the transistor $Q_1$ is connected to a negative voltage source $-V$. A voltage appearing at the collector of the transistor $Q_1$ is transmitted through a diode $D_2$ to the resistor $R_6$ which is in turn connected to the negative voltage source $-V$. A voltage then appears across the resistor $R_6$, which is transmitted to one input of a summing circuit 18**.

The switching circuit further includes a transistor $Q_2$ having its base connected through a resistor $R_7$ to the output of the signal converter 14 and its emitter connected to the negative voltage source $-V$. The collector of the transistor $Q_2$ is connected through a resistor $R_8$ to a positive voltage source $+Vcc$ and connected through a resistor $R_9$ to the base of a transistor $Q_3$. The transistor $Q_3$ has its emitter connected to the negative voltage source $-V$ and its collector connected through a resistor $R_{10}$ to the output of the operational amplifier $OP_2$ and connected through a diode $D_1$ to the resistor $R_6$.

The summing circuit 18 includes an operational amplifier $OP_3$ having its inverting input connected through a resistor $R_{10}$ to the output of the integrator 17 and connected through a resistor $R_{11}$ to the output of the proportional component generator **16*a*. The noninverting input of the operational amplifier $OP_3$ is grounded. A resistor $R_{12}$ is connected across the inverting input and output of the operational amplifier $OP_3$. The circuit 18 functions to sum the output signals from the integrator 17 and the proportional component generator 16*a***.

Referring to FIGS. 5A, 5B and 5C, the operation of the circuit **16*a*** will be described hereinbelow.

The integrator 17 is adapted to produce an integral of an input signal applied thereto. When, therefore, the integrator 17 receives pulses from the signal converter 14, the integrator 17 produces a continuous signal decreasing in such a manner as shown in dotted line in FIG. 5A. In this instance, the transistor $Q_1$ repeats ON and OFF states so that a signal appearing at a junction $J_A$ has a waveform such as that shown by the solid line in FIG. 5A. The transistors $Q_2$ and $Q_3$ and the diode $D_1$ cooperate to produce at a junction $J_B$ a signal having a waveform such as that shown by the solid line in FIG. 5B. The signals at the junctions $J_A$ and $J_B$ are superposed on each other at a junction $J_C$ therefore causing a signal having a waveform such as that shown by the solid line of FIG. 5C.

In FIGS. 6A, 6B and 6C, there are illustrated three different output signals from the signal converter 14, respectively illustrated by a phantom line a, a dotted line b and a solid line c. When these signals or signals such as these are supplied to the control circuit 15' in different time periods, the circuit 15' produces output signals corresponding to the input signals and having such waveforms such as those shown by lines a', b' and c' of FIG. 7. As seen from FIG. 7, the respective output signals have different proportional components $P_1$, $P_2$, and $P_3$ the magnitudes of which are proportional to the magnitudes of the corresponding integral components.

As is apparent from the above description, the control circuit according to the present invention produces control signals having a proportional component P with magnitudes varying directly with the magnitude of the integral component. Accordingly, the hunting amplitude in the control signal supplied to the air-fuel ratio regulator can be suppressed, and more accurate air-fuel ratio control can be performed.

It will be understood that the invention is not to be limited to the exact construction shown and described and that various changes and modifications may be made without departing from the spirit and scope of the invention, as defined in the appended claims.

What is claimed is:

1. In an air-fuel ratio control system for use with an internal combustion engine including means for supplying air and fuel thereto in a ratio variable in response to a P-I control signal and including exhaust means having an exhaust gas treatment means operative when supplied with exhaust gases containing air and fuel in a certain ratio, which system includes an air-fuel ratio detector connected to said exhaust means, for producing an air-fuel ratio signal indicative of an air-fuel ratio of the exhaust gases, and a control circuit for producing said P-I control signal in response to said air-fuel ratio signal, the control circuit comprising:

an integrator connected to said air-fuel ratio detector, for integrating said air-fuel ratio signal to provide integral components of the P-I control signal on an output of the integrator;

an inverter connected to said integrator, for inverting the integrated signal from said integrator;

a switching circuit for passing therethrough the integrated signal when said air-fuel ratio signal is lower than a predetermined level and the inverted integrated signal when said air-fuel ratio signal is higher than said predetermined level to provide proportional components of the P-I control signal on an output thereof, said switching circuit providing means for varying the amplitude of the proportional components of the P-I control signal directly with the integral component; and a summing circuit with an input connected to the outputs of the integrator and switching circuit for producing a summation of the output signals of said integrator and said switching circuit.

2. An air fuel ratio control system according to claim 1, in which said inverter includes an operational amplifier having a grounded direct input terminal with a resistor connected across the indirect input terminal and an output terminal thereof.

3. An air fuel ratio control system according to claim 1, in which said switching circuit includes a first switching circuit which connects the output of said integrator to the input of said summing circuit when said air-fuel ratio signal is lower than said predetermined level and a second switching circuit which connects the output of said inverter to the input of said summing circuit when said air-fuel ratio signal is higher than said predetermined level.

4. An air fuel ratio system according to claim 3, in which said first switching circuit includes a first transistor having a base connected to the input of said integrator and a collector connected through a resistor to the output of said integrator, an emitter of said first transistor being connected to a low voltage source, and a diode connected across the collector of said first transistor and the input of said summing circuit.

5. An air fuel ratio control system according to claim 4, in which said second switching circuit includes a second transistor having a base connected to the input of said integrator and a collector connected through a resistor to a high voltage source, an emitter of said second transistor being connected to said low voltage source, a third transistor having a base connected to the collector of said second transistor and an emitter connected to said low voltage source, and a diode connected across the collector of said third transistor and the input of said summing circuit.

6. In an air fuel ratio control system for use with an internal combustion engine wherein the engine includes an exhaust system having an exhaust gas treatment means which operates when exhaust gases containing air and fuel in a certain ratio are passed therethrough; wherein the air fuel ratio control system includes an air-fuel ratio detector in the exhaust system for producing an air-fuel ratio signal indicative of an air-fuel ratio in exhaust gases, and wherein the air-fuel ratio control system includes a control signal generating circuit for generating a control signal with proportional and integral components wherein the integral components increase in magnitude with engine speed and wherein the control signal controls the ratio of fuel-to-air supplied to the engine, the control signal generating circuit comprising:

an integrating circuit connected to the air-fuel ratio detector for integrating the air-fuel ratio signal to produce on an output thereof output signals are the integral components of the control signal;

a proportional signal generator for generating on an output thereof the proportional components of the control signal; the proportional signal generator including:

an inverting circuit having an input connected to the output of the integrating circuit for inverting the output signal of the integrating circuit to produce an inverted proportional component on an output;

a switching circuit connected to the output of the integrating circuit and to the inverting circuit for passing the proportional component when the air-fuel ratio signal is lower than a predetermined level and the inverted proportional component when the air-fuel ratio signal is higher than the predetermined level, said switching circuit providing means for varying the amplitude of the proportional components directly with the magnitude of the integral components, and a summing circuit having an input connected to the outputs of the integrating circuit and to the proportional signal generator for summing the integral and proportional components to produce the control signal.

7. An air-fuel ratio control system according to claim 6, in which the inverting circuit includes an operational amplifier having a grounded direct input terminal and an output terminal with a resistor connected across the indirect input terminal and the output terminal.

8. An air-fuel ratio control system according to claim 6, in which the switching circuit includes a first switching circuit which connects the output of the integrating circuit to the input of the summing circuit when the air-fuel ratio signal is lower than the predetermined level and a second switching circuit which connects the output of the inverting circuit to the input of the summing circuit when the air-fuel ratio signal is higher than the predetermined level.

9. An air-fuel ratio control system according to claim 8, in which the first switching circuit includes a first transistor having a base connected to the input of the integrating circuit and a collector connected through a resistor to the output of the integrating circuit, an emitter of the first transistor connected to a low voltage source, and a diode connected across the collector of the first transistor and the input of the summing circuit.

10. An air-fuel ratio control system according to claim 9, in which the second switching circuit includes a second transistor having a base connected to the input of said integrating circuit and a collector connected through a resistor to a high voltage source, an emitter of said second transistor is connected to said low voltage source, a third transistor having a base connected to the collector of said second transistor and an emitter connected to the low voltage source, and a diode connected across the collector of the third transistor and the input of the summing circuit.

* * * * *